US007736281B2

(12) United States Patent
Corbalis et al.

(10) Patent No.: US 7,736,281 B2
(45) Date of Patent: Jun. 15, 2010

(54) RECUMBENT BICYCLE

(75) Inventors: Kevin P. Corbalis, Tustin, CA (US); Mark William Chiles, Yorba Linda, CA (US); Victor Torres Cornejo, Tustin, CA (US); Felipe J. Marin, Santa Ana, CA (US)

(73) Assignee: Unisen, Inc., Irvine, CA (US)

( * ) Notice: Subject to any disclaimer, the term of this patent is extended or adjusted under 35 U.S.C. 154(b) by 1095 days.

(21) Appl. No.: 10/759,539

(22) Filed: Jan. 19, 2004

(65) Prior Publication Data

US 2004/0198561 A1 Oct. 7, 2004

Related U.S. Application Data

(60) Provisional application No. 60/441,330, filed on Jan. 17, 2003.

(51) Int. Cl.
*A63B 22/06* (2006.01)

(52) U.S. Cl. ..... 482/57; 248/444.1

(58) Field of Classification Search ..... 482/51, 482/56–59, 52, 54; D21/662–667, 191, 194; 248/444.1, 445, 447.2, 446, 447, 458, 460
See application file for complete search history.

(56) References Cited

U.S. PATENT DOCUMENTS

| | | | | |
|---|---|---|---|---|
| 436,403 | A * | 9/1890 | Dabbs | 224/448 |
| 2,485,135 | A * | 10/1949 | Blumenstock | 248/453 |
| D320,826 | S * | 10/1991 | Hildebrandt et al. | D21/666 |
| D342,299 | S | 12/1993 | Birrell et al. | |
| D347,039 | S | 5/1994 | Littrell et al. | |
| D355,942 | S * | 2/1995 | Wu | D21/666 |
| D362,699 | S | 9/1995 | Heaton et al. | |
| 5,579,969 | A * | 12/1996 | Brandell | 224/277 |
| 5,690,582 | A | 11/1997 | Ulrich et al. | |
| 5,823,915 | A * | 10/1998 | Chen | 482/57 |
| 5,890,995 | A | 4/1999 | Bobick et al. | |
| 6,001,046 | A | 12/1999 | Chang | |
| 6,042,518 | A * | 3/2000 | Hildebrandt et al. | 482/57 |
| 6,142,916 | A * | 11/2000 | Byrd | 482/57 |
| D439,289 | S | 3/2001 | Moran et al. | |
| D461,210 | S | 8/2002 | Fon | |
| 6,450,923 | B1 * | 9/2002 | Vatti | 482/8 |
| 6,474,193 | B1 | 11/2002 | Farney | |
| 6,582,343 | B2 * | 6/2003 | Lin et al. | 482/53 |

(Continued)

FOREIGN PATENT DOCUMENTS

| | | |
|---|---|---|
| DE | 297 20 132 U1 | 1/1998 |
| DE | 299 18 004 U1 | 1/2000 |

OTHER PUBLICATIONS

Digital Image of Tunturi F520 2001.

(Continued)

*Primary Examiner*—Loan H Thanh
*Assistant Examiner*—Tam Nguyen
(74) *Attorney, Agent, or Firm*—Knobbe, Martens, Olson & Bear, LLP

(57) ABSTRACT

An exercise machine has a number of features relating to ease of use. The machine has a widened step through design, improved foot straps, an adjustable reading display or a pivotal arm rest.

35 Claims, 12 Drawing Sheets

U.S. PATENT DOCUMENTS

| | | | | |
|---|---|---|---|---|
| D479,865 | S * | 9/2003 | Arai et al. | D21/666 |
| 6,652,425 | B1 | 11/2003 | Martin et al. | |
| 6,841,726 | B2 * | 1/2005 | Steffens et al. | 84/486 |
| 6,852,070 | B1 * | 2/2005 | Herbert | 482/57 |
| 2003/0199363 | A1 * | 10/2003 | Chen | 482/4 |
| 2004/0007090 | A1 * | 1/2004 | Liou | 74/594.6 |

OTHER PUBLICATIONS

Cycling in a Recumbent Position, National Fitness Trade Journal, Fall, 1998, Author: Dennis Michaelson, pp. 18 & 19.

Star Track Introduces New V-Bike, National Fitness Trade Journal, Fall, 1998; pp. 22, 23, 25.

Website page of Tunturi Recumbent Cycle F 570: http://web.archive.org/web/19970418121321/www.tunture.com/f570.html.

Website page of Tunturi F520; http://web.archive.org/web/20010430051355/www.tunturi.com/php/fitness.php?tr _id=7&tuote_id=112.

International Search Report; dated Oct. 20, 2008; 5 pages.

* cited by examiner

RECUMBENT BICYCLE

RELATED APPLICATIONS

This application claims the priority benefit of U.S. Provisional Application No. 60/441,330, filed on Jan. 17, 2003, which is hereby incorporated by reference in its entirety.

BACKGROUND OF THE INVENTION

1. Field of the Invention

The present invention generally relates to exercise bicycles. More specifically, the present invention relates to exercise bicycles having improved step through regions and/or moveable reading supports.

2. Description of the Related Art

The exercise industry manufactures a variety of machines that provide users with cardiovascular exercise. These machines include stepper machines, elliptical machines, spinner bicycles and recumbent bicycles. The design of each of these types of machines results in certain advantages and disadvantages.

Users weigh many factors in determining which exercise equipment to use during time spent in a gym or when exercising at home. Among the factors weighed is ease of use. Accordingly, exercise equipment designers have continually sought to improve the ease of use of the various machines.

SUMMARY OF THE INVENTION

One area in which current exercise bicycle designs need improvement is entry and exit access. Current bicycle designs generally feature an enclosed elevated region between the seat and the handlebars. This enclosed region generally houses drive train components that are used to adjust the level of pedaling difficulty. This enclosed region, however, requires a user to raise a leg over the enclosed region when mounting and dismounting the bicycle. Some designs have provided a slight separation between the handlebars and the seat, which separation provides some degree of clearance. These designs, however, generally taper in a downward direction such that the narrowest region is at the bottom. This is disadvantageous in that users may not be able to easily mount and dismount the equipment. For instance, because people have different foot sizes, some people will have to lift their foot higher than others in order to mount or dismount the bicycle.

Current designs also are fairly heavy and difficult to move. In some gyms, users like to talk while exercising. In such instances, the equipment may not be positioned relative to other equipment in a manner that allows easy conversation. Thus, equipment that is made for easier movement during relocation while still maintaining an adequately fixed positioned during exercise is desired. Such equipment also can facilitate cleaning the floor around the equipment.

Often, people using exercise machines also read while exercising. Reading on some equipment, however, is fairly difficult. For instance, the reading material must be held during the exercise, which can be fairly difficult for extended periods of time. In addition, if a reading support is provided, the support may not be properly positioned for each user. Accordingly, an adjustable reading support is desired.

In accordance with one embodiment of the present invention, an exercise machine comprises a frame. The frame comprises a base. A seat is mounted to a rear portion of the frame and a display is mounted to a forward portion of the frame. A resistance force generating assembly is disposed generally below a portion of the display. The assembly is disposed within a first housing. A second housing is formed separate of the first housing and is disposed generally rearward of the first housing. An opening is defined between the first and the second housings and the opening is wider at a location proximate the base than at an elevation higher than the location.

In accordance with another embodiment of the present invention, an exercise machine comprises a frame with a seat supported by a rear portion of the frame. A forward portion of the frame supports a hand grip and the forward portion of the frame movably supports a reading support. The reading support is disposed forward of the seat and is adjustable relative to the seat.

BRIEF DESCRIPTION OF THE DRAWINGS

These and other features, aspects and advantages of the present invention will now be described with reference to the drawings of a preferred embodiment, which embodiment is intended to illustrate and not to limit the invention. The figures comprise 15 drawings.

DETAILED DESCRIPTION OF THE PREFERRED EMBODIMENT

With reference now to FIGS. 1-6, a recumbent bicycle 10 is illustrated therein. While various features, aspects and advantages of embodiments of the present invention will be described in the context of the illustrated bicycle, certain features, aspects and advantages can be used with other types of exercise equipment. Accordingly, while illustrating the below-described features, aspects and advantages in the context of a bicycle-type of exercise apparatus, it is not intended that the scope of the present invention necessarily be limited to such exercise apparatuses unless expressly recited by the claims.

Figure 1:
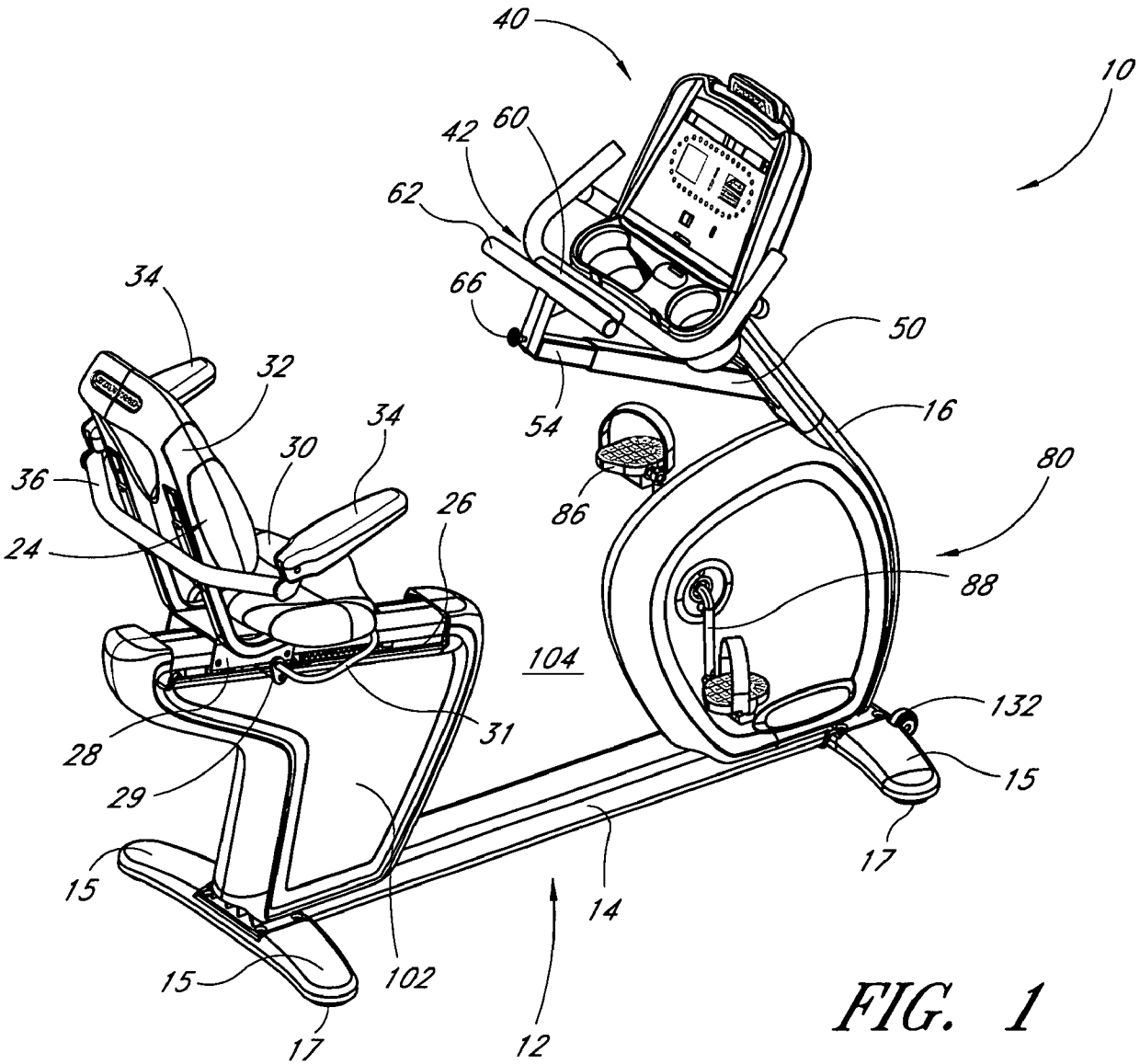
FIG. 1 is a perspective view of a bicycle arranged and configured in accordance with certain features, aspects and advantages of the present invention.
Figure 3:
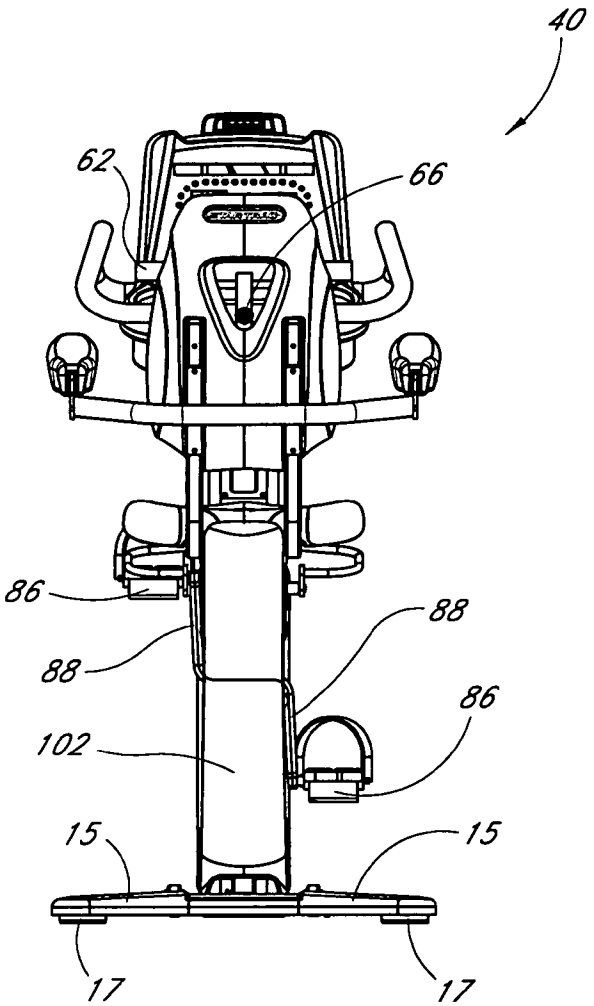
FIG. 3 is rear elevation view of the bicycle of FIG. 1.
Figure 2:
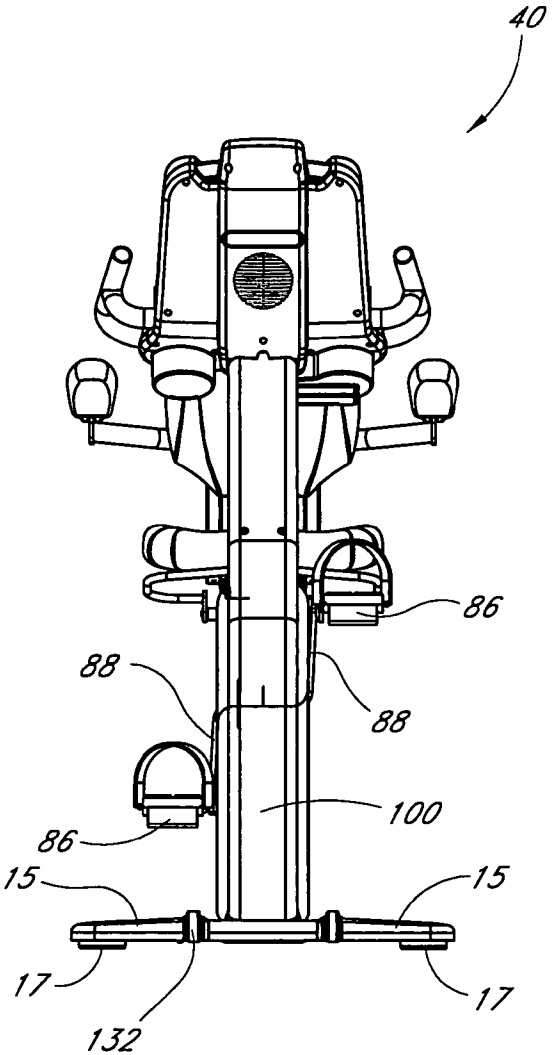
FIG. 2 is a front elevation view of the bicycle of FIG. 1.
Figure 7:
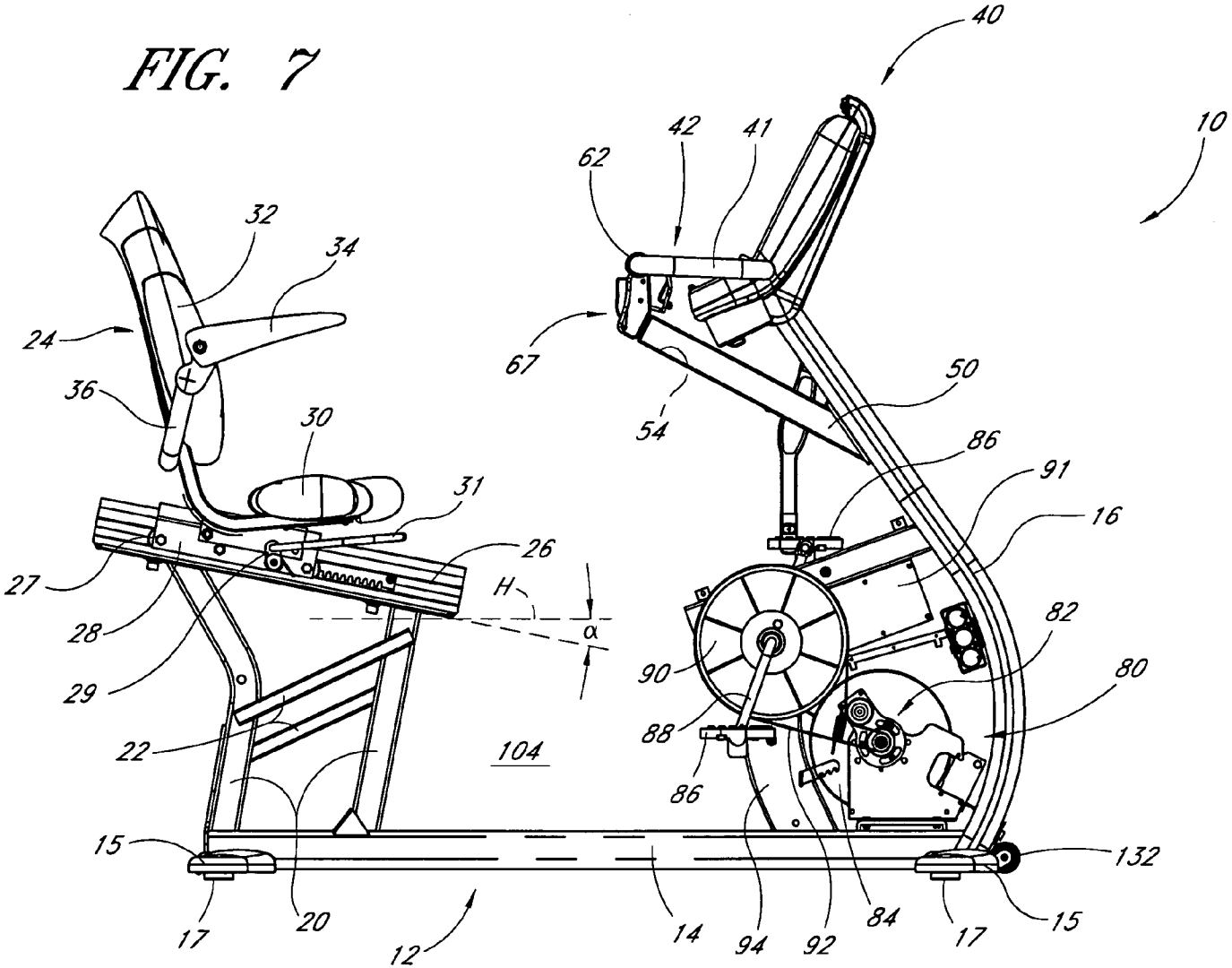
FIG. 7 is a side elevation view of another bicycle arranged and configured in accordance with certain features, aspects and advantages of the present invention.
Figure 8:
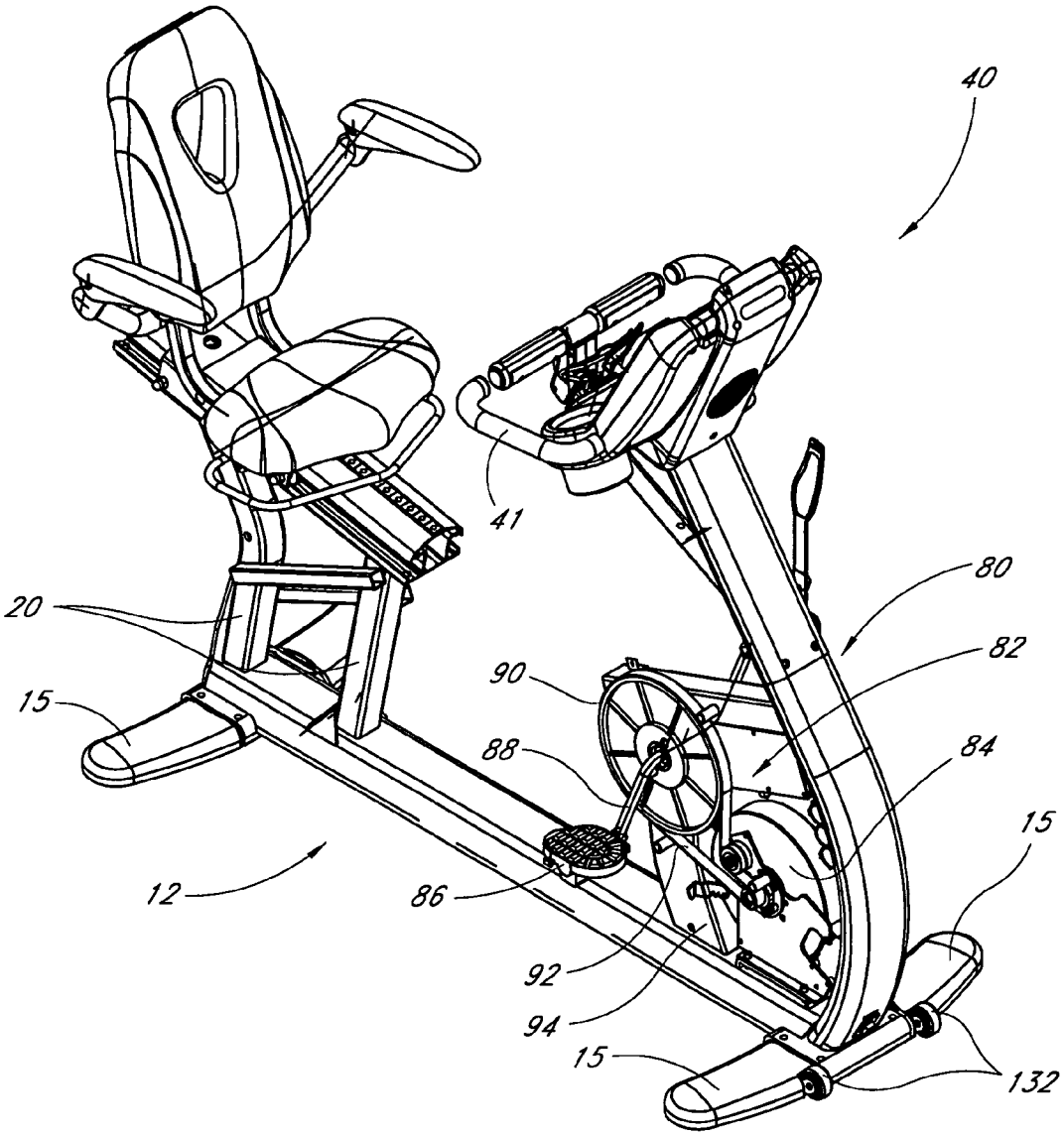
FIG. 8 is perspective view of the bicycle of FIG. 7.

With reference now to FIGS. 1, 7 and 8, the illustrated bicycle 10 advantageously comprises a simplified frame assembly 12. The illustrated frame assembly 12 comprises a base 14 that curves upward at a forward end of the frame assembly 12 such that it forms a standard 16. The base 14 in the illustrated arrangement is formed of a rectangular aluminum tube. Other shapes and materials also can be used, as desired. A pair of legs 15 extends laterally outward at both a forward end and a rearward end of the base 14. Advantageously, a leveling foot 17 can be disposed along a bottom portion of each leg 15. The leveling foot 17 can be raised or lowered by rotation such that the frame assembly 12 can be mounted in a level orientation irrespective of the levelness of the floor.

In the illustrated arrangement, the base 14 and the standard 16 are separately formed and secured together in a suitable manner, including but not limited to, welding, physical interlocking connections, mechanical fasteners and the like. In some embodiments, the base 14 and the standard 16 can be integrally formed. While the illustrated arrangement may reduce tooling costs, the integrated arrangement could reduce overall manufacturing costs during mass production.

A pair of longitudinally spaced seat standards 20 extend upward from a rear portion of the base 14. As used herein, the longitudinal direction is the direction in which a user faces during operation of the bicycle 10 (e.g., front to rear). In the illustrated arrangement, a pair of stays 22 extends longitudinally between the two seat standards 20 to reinforce the seat standards 20. Specifically, in the illustrated arrangement, the stays 22 slope upward from the rearward standard 20 to the forward standard 20. Other seat supporting and elevating constructions can be used if desired.

A seat 24 is positioned above and supported by the seat standards 20 in the illustrated arrangement. The seat 24 preferably is positioned over a slide plate 26 that is mounted to the seat standards 20. The slide plate 26 can be mounted at an angle $\alpha$ to horizontal H (see FIGS. 4 and 7). By mounting the slide plate 26 at an angle, the seat can be adjusted both toward the pedals and up and down in a manner that allows proper ergonomics to be achieved.

The seat 24 preferably engages the slide plate 26 in a manner that secures the seat from being lifted from the slide plate 26. In one embodiment, the seat 24 can be mounted on rollers 27 that roll within a channel formed in the slide plate 26 or the slide plate can contain rollers over which a rail connected to a portion of the seat 24 rolls. Other manners of allowing the seat to translate also can be used.

The slide plate 26 comprises inwardly extending channels that are positioned on the lateral sides of the plate 26. A framework 28 is supported by rollers 27 that are positioned within the channels such that the framework 28 can be formed fore and aft along the slide plate 26. This arrangement allows the slide to be adjusted forward and rearward in any suitable manner.

In one arrangement, a seat lock 29 has a handle 31 that is positioned proximate a forward portion of the seat 24, which handle 31 unlocks the seat 24 for movement when the handle 31 is manipulated and locks the seat 24 against movement when the handle 31 is released. In some embodiments, the seat locking arrangement is similar to those used in the automotive industry for adjustably fixing the location of manually adjustable seats. For instance, as illustrated, a wrap-around handle can be used which allows adjustment of the seat by lifting the handle from two or more one contiguous sides.

The seat 24 in the illustrated arrangement comprises a pair of cushions that are connected to the framework 28: a bottom cushion 30 and a back cushion 32. In some arrangements, a single cushion can be used to provide both vertical and longitudinal support.

Figure 4:
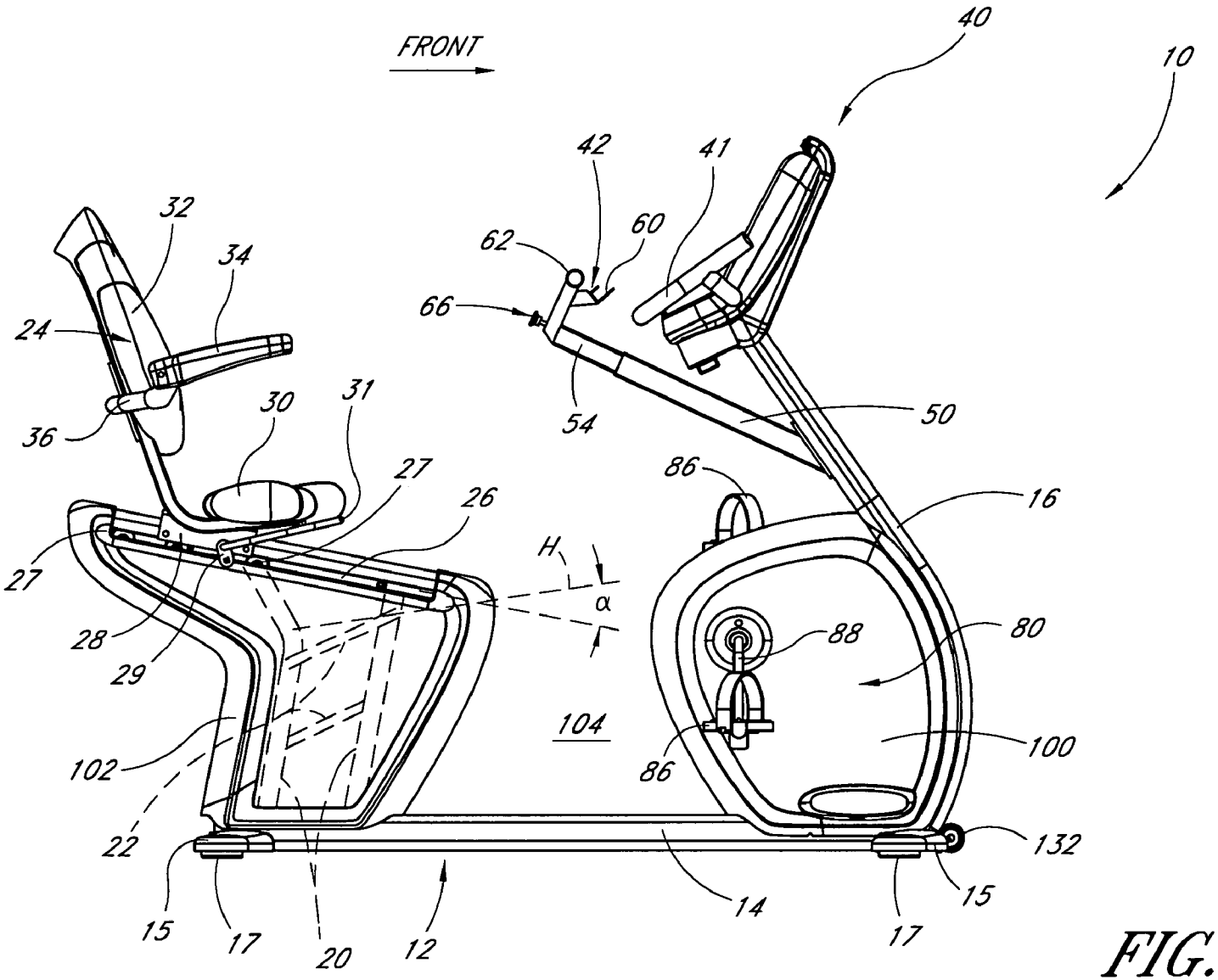
FIG. 4 is a side elevation view of the bicycle of FIG. 1.
Figure 5:
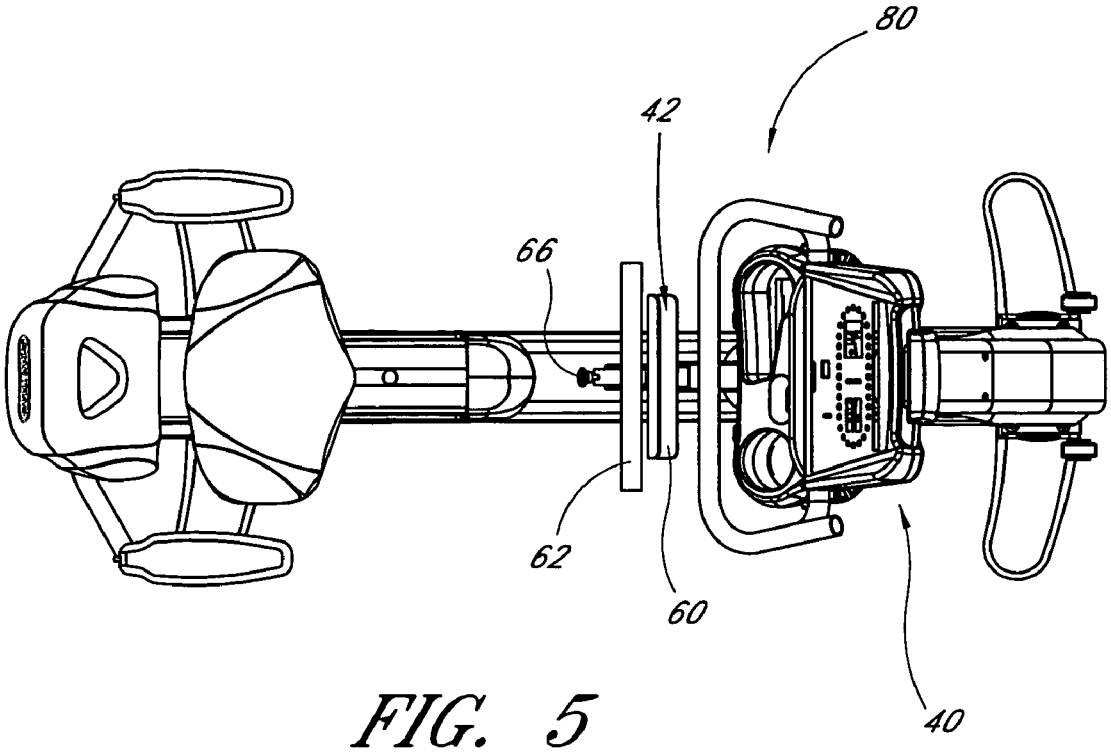
FIG. 5 is a top plan view of the bicycle of FIG. 1.
Figure 6:
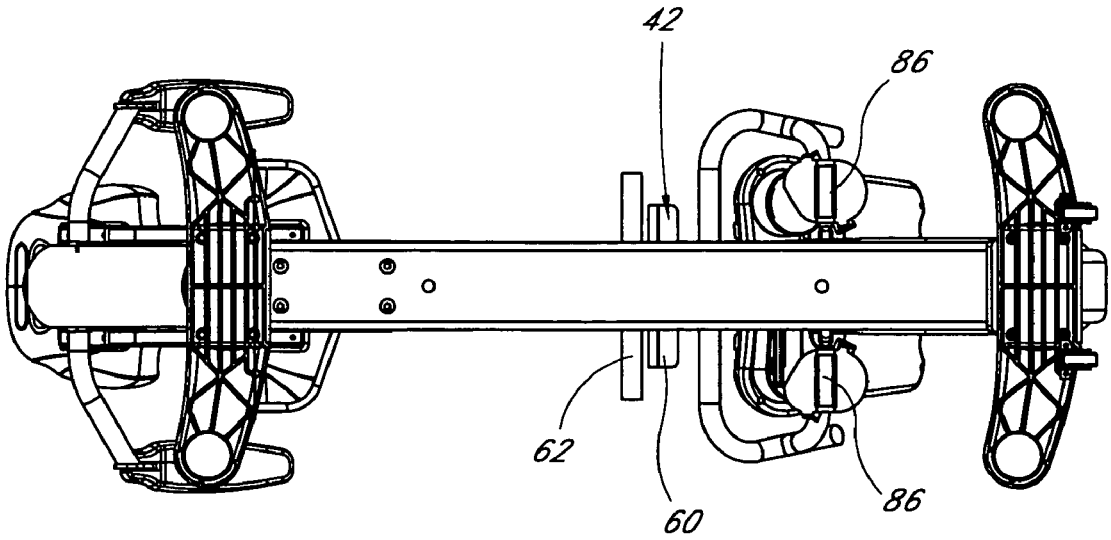
FIG. 6 is a bottom plan view of the bicycle of FIG. 1.

Two arm rests 34 (see FIG. 2) also are connected to the framework 28. The arm rests 34 allow a user to better hold a magazine, book, newspaper or the like while riding the bicycle. In one arrangement, the arm rests 34 are connected to a single arm rest support 36, which is generally U-shaped. The support 36 extends to both lateral sides of the bottom cushion 30. In the embodiment of FIG. 4, the support 36 extends laterally and generally longitudinally and, in the embodiment of FIG. 7, the support 36 extends laterally and generally vertically. In other arrangements, the arm rests 34 can be pivotally connected to the framework 28 or other portion of the seat 34 or bicycle 10 such that the arm rests 34 can be pivoted upward and rearward or outward and rearward relative to the seat 24 to facilitate entry to and exit from the seat 24.

An upper portion of the standard 16 supports a display 40. The display can have any suitable construction. Preferably, the display 40 comprises an electronic readout or other suitable configuration to allow the user to receive information regarding the rate of speed, calories burned and the like. In addition, the display preferably allows the input of information by the user. Heart rate sensors 41 and the like also can be mounted proximate the display 40. The electronics relating to the display 40 and the sensors 41 can be connected to a power source with cables that extend through the standard 16. Such displays are well known to those of ordinary skill in the art.

Proximate the display 40, the bicycle 10 also can feature a reading support 42, which is either integrated or separately formed relative to the display 40. In the arrangements illustrated in FIG. 4 and FIG. 8, the reading supports 42 are formed separate of the display 40. Advantageously, the reading support 42 can be designed for articulation relative to the frame assembly 12. In some arrangements, the reading support 42 is designed to move toward or away from the display 40. In other arrangements, the reading support 42 is designed to move with the display 40 relative to the frame assembly 12 and the user. In one arrangement, a four bar linkage is used to allow the reading support 42 to be positioned as desired by the user (e.g., change the height, angle and/or distance to the user).

Figure 9:
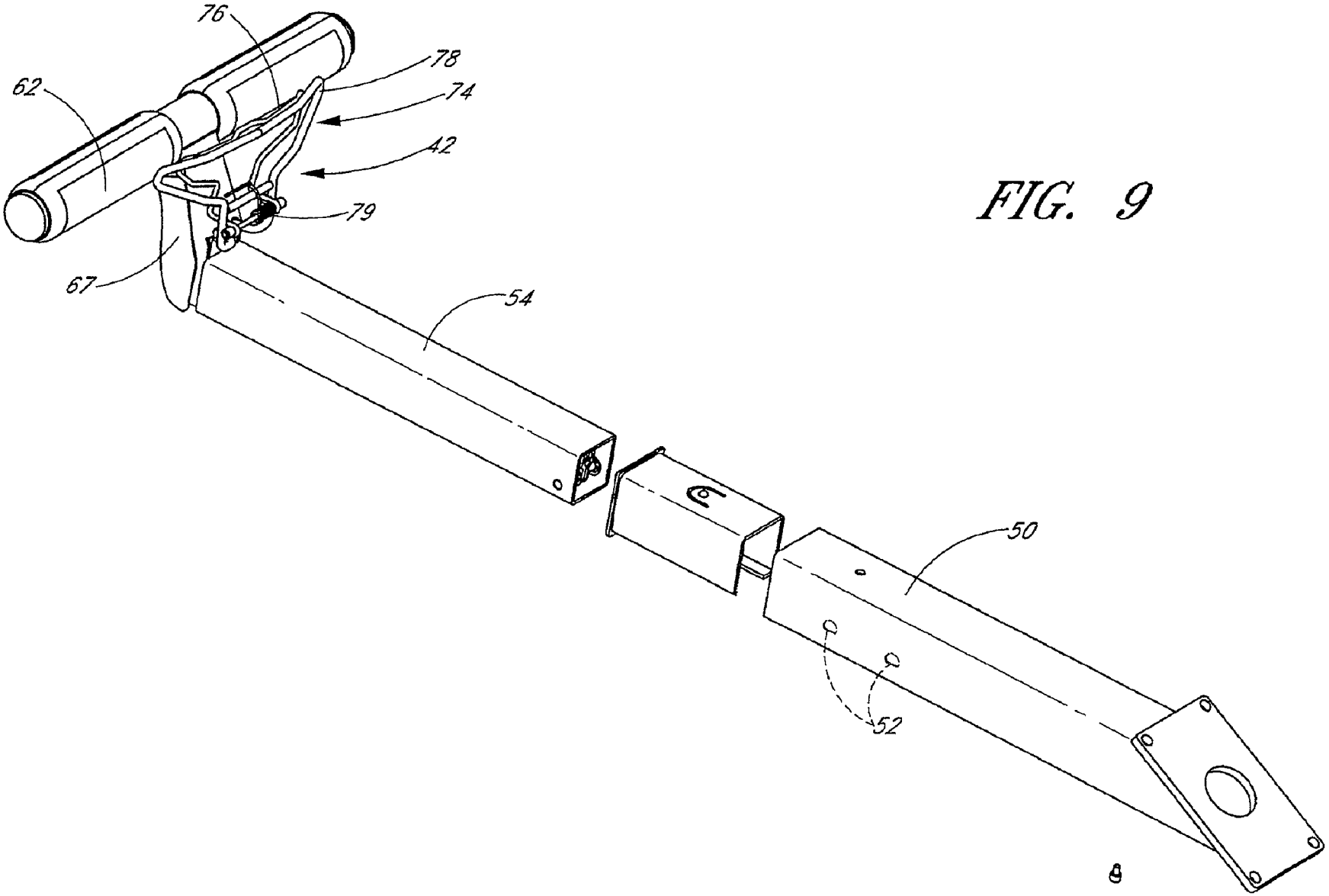
FIG. 9 is a perspective view of a reading support of the bicycle of FIG. 7 with a portion of the standard shown in broken section.
Figure 10:
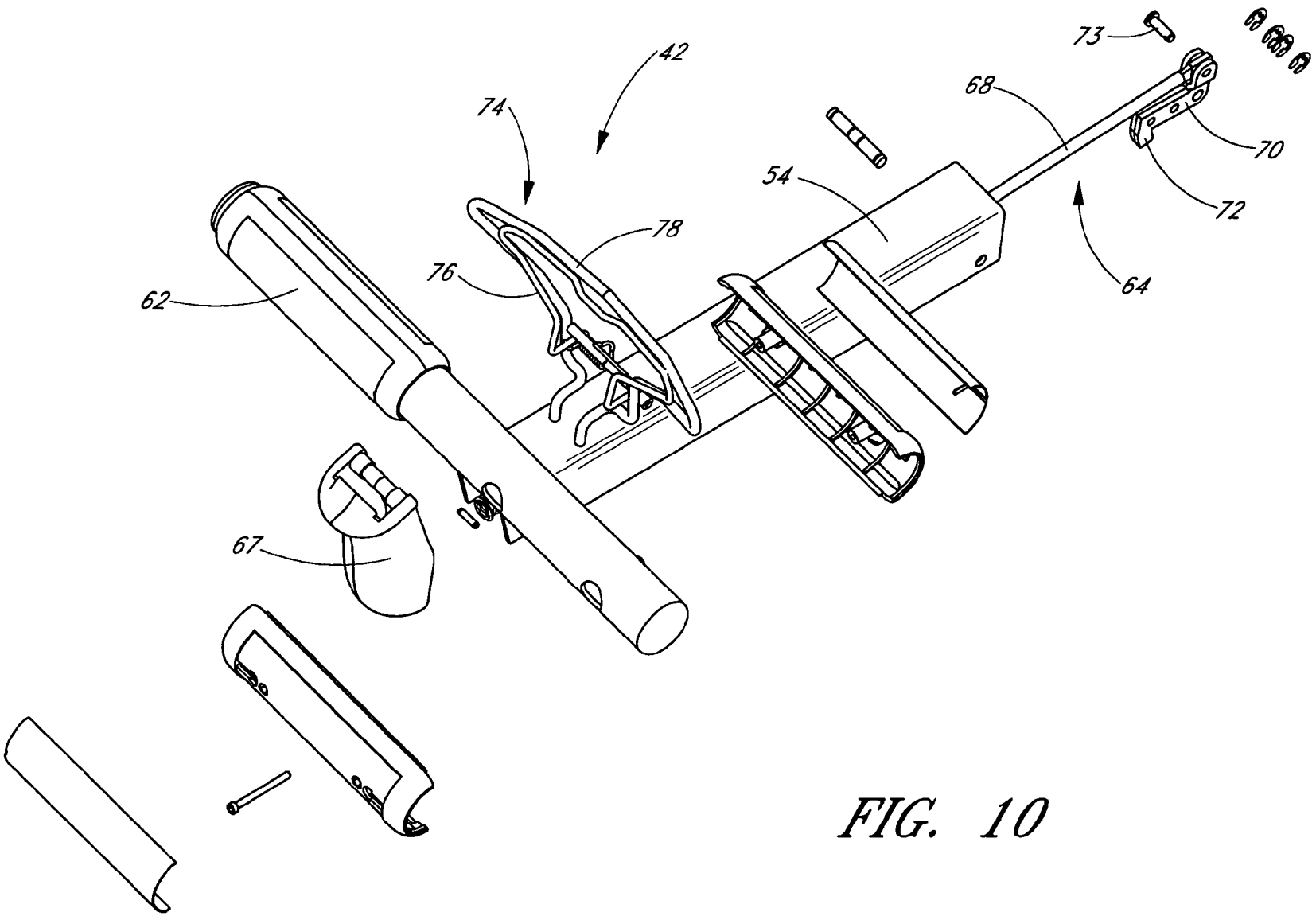
FIG. 10 is an exploded perspective view of the reading support and display assemblies of the bicycle of FIG. 7.
Figure 11:
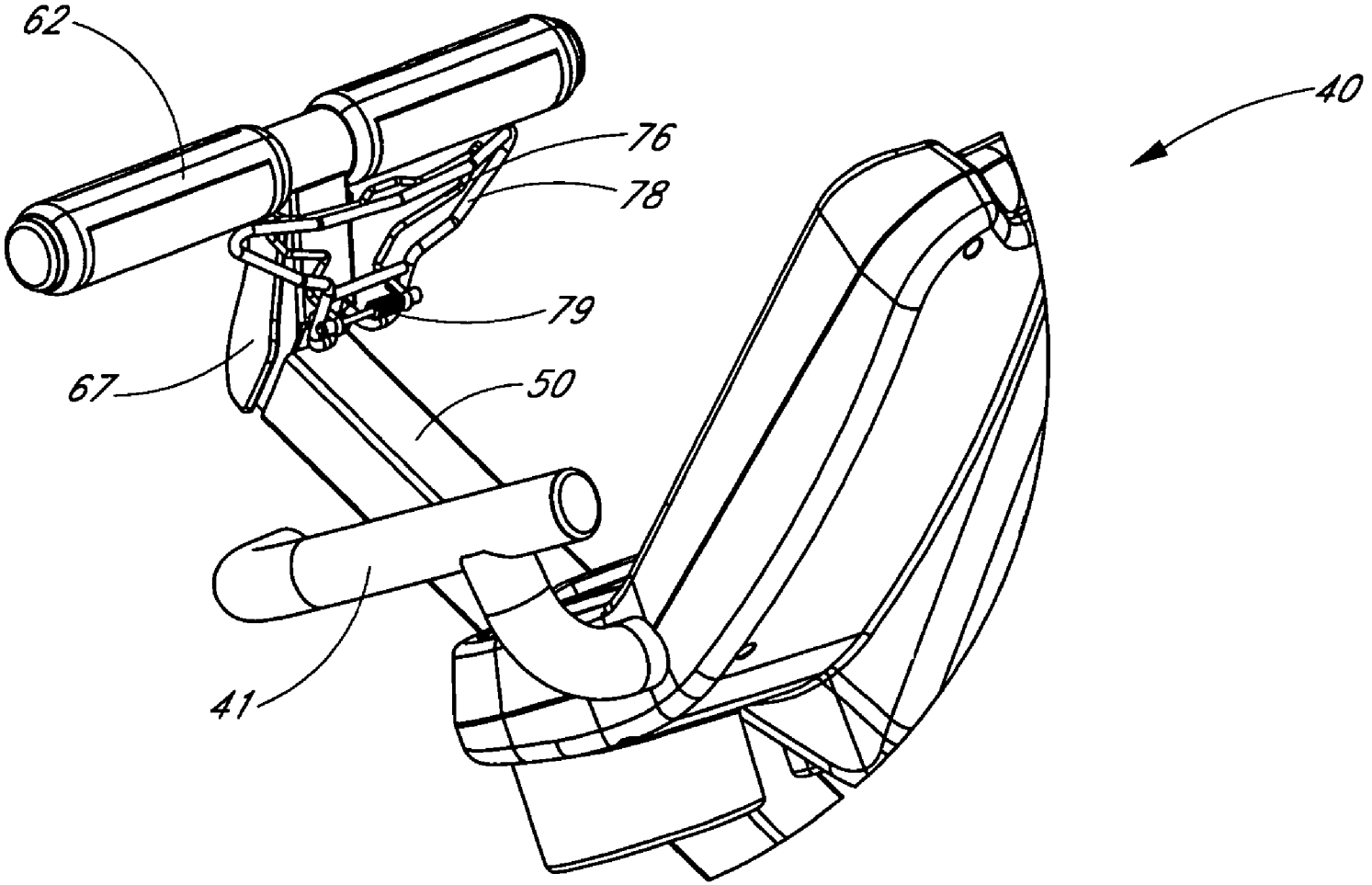
FIGS. 11 and 12 are perspective views of the reading support and display assemblies of the bicycle of FIG. 7.
Figure 12:
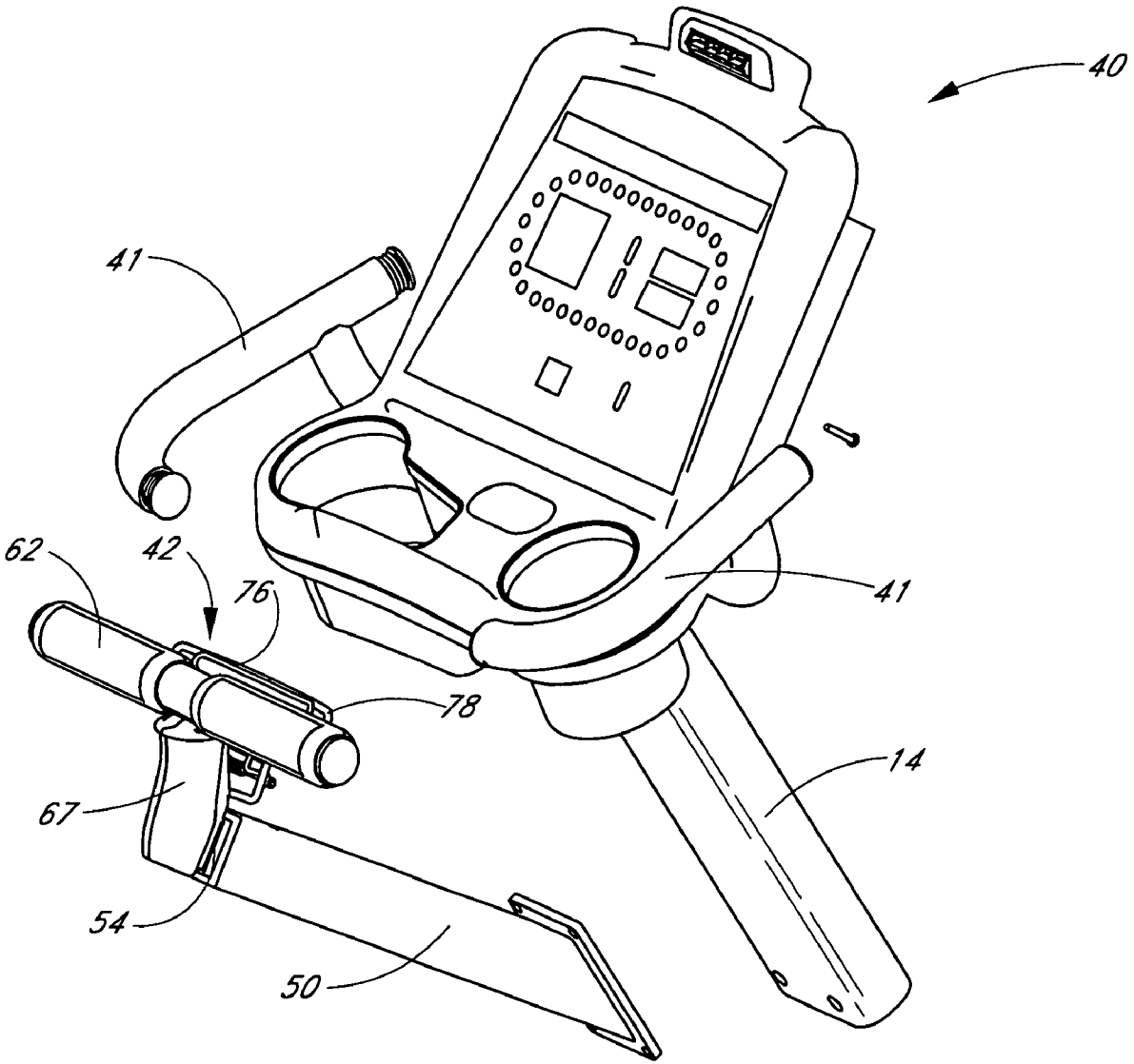

With reference to FIGS. 9-11 in one arrangement, the bicycle 10 comprises a strut 50 that is suitably supported by the frame assembly. The illustrated strut 50 is secured with fasteners to the standard 16. Other mounting techniques also can be used (e.g., welding, mechanically interlocking constructions, etc.). In the illustrated embodiment, the strut 50 is a sleeve. The illustrated strut 50 comprises a number of holes 52. The reading support 42 also comprises an elongated support member 54. The support member 54 of the reading support 42 is designed to slide within the strut 50 of the frame assembly 12 in a telescoping manner. In some arrangements, the strut 50 may be designed to slide within the support member 54 rather than the support member 54 being designed to slide within the strut 50. Other functional relationships that allow the reading support 42 to be carried by the frame assembly 12 in a suitably adjustable manner also can be used.

The reading support 42 of the arrangement illustrated in FIGS. 1-4 comprises a channel 60 and a handgrip assembly 62. The channel 60 advantageously has been designed to accommodate various reading media. While the illustrated channel is fairly short in height, it should be appreciated that an extension member could extend upward to provide added support for reading media. In one arrangement, such an extension member can be manufactured of a clear lexan or Plexiglas material in order to allow a user to see the display 40 through the extension member.

The handgrip assembly 62 advantageously comprises heart rate sensors. While the handgrip assembly 62 moves with the channel 60 in the illustrated arrangement, the channel 60 may be designed to move separate of the handgrip assembly 62 if desired.

With reference initially to FIG. 10, a plunger assembly 64 is provided to adjust the relative positions of the support members 50, 54. As shown, a plunger knob 66 (FIG. 1) or button 67 (FIG. 9) is connected by a rod 68 to a rocker arm 70 that is disposed at the end opposite of the support member 54 relative to the plunger knob 66 or button 67. The rod 68 can be connected to the plunger knob 66 or button 67 in any suitable manner (e.g., threaded connection, mechanically interlocking connection, etc.). The rocker arm 70 pivots when the plunger knob 66 or button 67 is moved in an axial direction.

The pivoting of the rocker arm 70 allows a locking finger 72 to retract and extend, depending upon the rotational orientation of the rocker arm about an axis defined by a pin 73. When the locking finger 72 is extended, the locking finger 72 can selectively register with either of the holes 52 (shown in dashed lines in FIG. 9 because they are on the lower surface of the support member 50) once the finger is generally aligned with the respective hole 52. Thus, the finger 72 engages with one of the openings or holes 52 to lock the reading support in position.

In the embodiments of FIGS. 1 and 10, the plunger assembly is spring biased such that the locking pin 72 is extended when the plunger knob 66 is not being manipulated. To facilitate movement, the plunger knob 66 can be depressed to move the reading support 42 toward the display 40 and the plunger knob 66 can be pulled to move the reading support 42 away from the display 40. In the embodiment of FIG. 10, the button 67 is adapted to be pressed for movement and preferably is not designed for pulling movement as compared to the knob 66 of FIG. 1. Nevertheless, movement of the plunger knob 66 or the button 67 can be used to enable movement of the reading support 42 in either direction relative to the display 40 when such movement of the support 42 is desired.

With reference still to FIGS. 9-11, a second embodiment of the reading support 42 comprises a gripping structure 74. The gripping structure 74 enables the reading support 42 to physically secure reading media in position rather than simply supporting the reading media. In the illustrated arrangement, a front arm 76 and a rear arm 78 are biased with a biasing member 79 (e.g., a spring, etc.) to a closed position. In other arrangements, the front arm and/or the rear arm 78 can be made of a suitable material to allow sufficient deformation without yielding to allow the two members to simply secure the reading media between the two arms 76, 78. Using an arrangement such as that illustrated, which features the biasing member, however, facilitates the support and securement of a wider range of reading media sizes and shapes.

With reference again to FIG. 1, the illustrated bicycle 10 advantageously comprises a resistance region 80 that is separated from the seat 24. A resistance force generating assembly 82 (see FIG. 7) is contained within the resistance region 80. Any suitable resistance force generating assembly 82 can be used. For instance, belts, friction brakes and the like can be used. Preferably, however, a flywheel and generator combination 84 is used. As illustrated, two pedals 86 are connected via crank arms 88 to a circular crank 90. The crank 90 is connected with a tensioned belt drive 92 to the flywheel and generator combination 84. Advantageously, the combination 84 is mounted within a corner defined by the standard 16 and the base 14. Additionally, a bracing member 94 extends between the base 14 and the standard 16. The bracing member 94 defines a mounting location for the crank 90 and a circuit board 91.

With reference again to FIG. 1, the resistance region 80 preferably is housed within a resistance housing 100. Because of the compact arrangement of the resistance force generating assembly 82, the resistance housing 100 can for formed as a separate component from the other housings used on the bicycle. For instance, the resistance housing 100 can be formed separate of a seat housing 102 that is used to shroud the structure supporting the seat 24. Thus, as shown in FIG. 1, a valley 104 is defined between the resistance housing 100 and the seat housing 102. The valley 104 provides a step through design for the bicycle 10. The valley can have any suitable configuration. Advantageously, the illustrated valley 104 comprises a wider opening proximate the base than the width of the valley 104 at a vertically higher location. The wider opening proximate the base provides enhanced clearance at a level through which a user's foot will pass while mounting and dismounting the bicycle 10. While the illustrated valley 104 provides the advantage of growing wider as it goes downward, other configurations also can grow wider while descending and, as such, the illustrated design provides an aesthetically unique and pleasing appearance.

Figure 13:
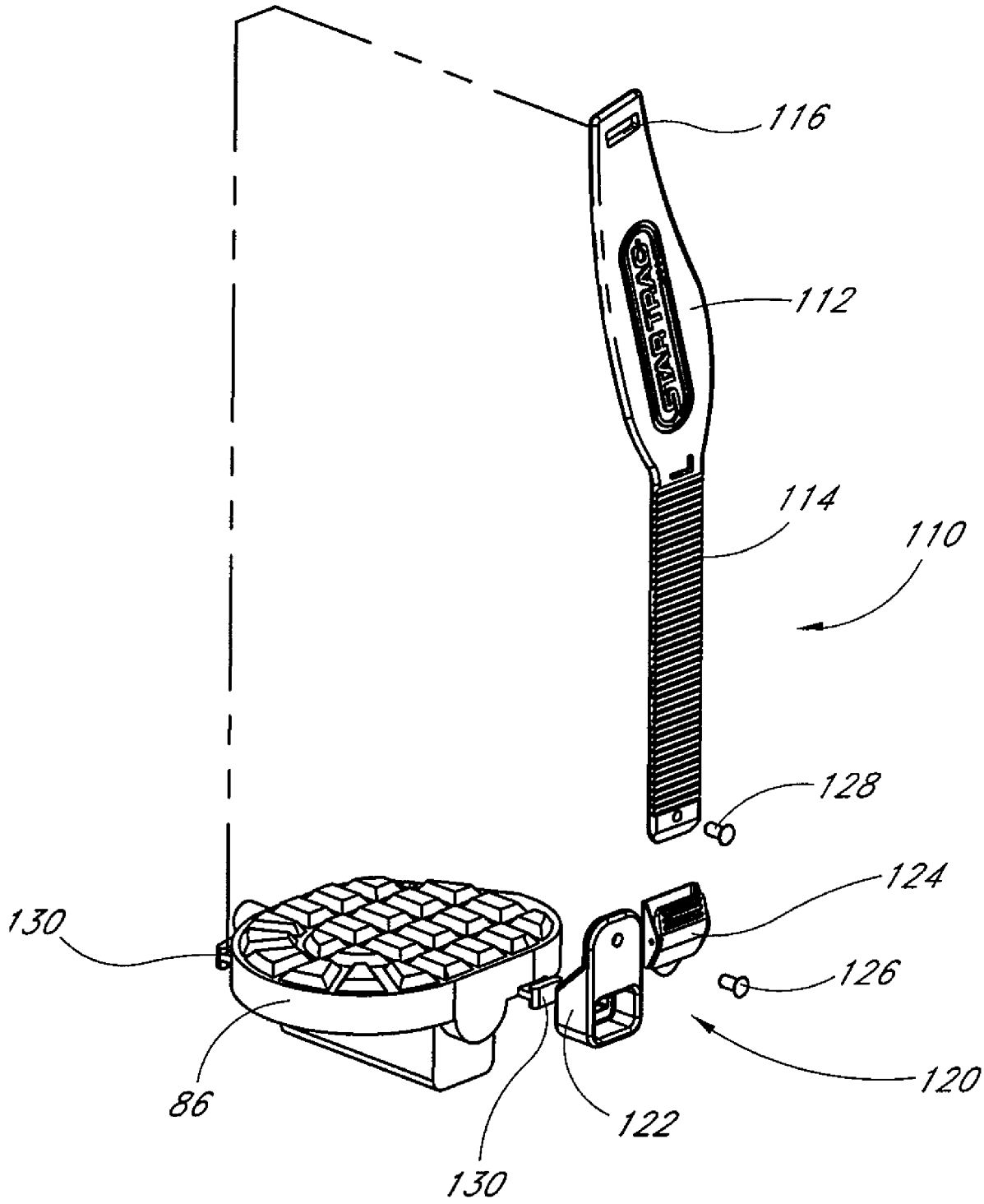
FIG. 13 is an exploded perspective view of a pedal and foot strap assembly that is arranged and configured in accordance with certain features, aspects and advantages of the present invention.

The pedals 86 each preferably comprises a foot strap arrangement 110. Any suitable foot strap arrangement can be used (e.g., hook and loop style such as Velcro, buckles, clips, etc.). With reference to FIG. 13, the foot strap arrangement 110 comprises a flexible strap 112. The illustrated strap 112 comprises a ribbed portion 114 at one end and an aperture 116 at the other end. A wider portion 118 is interposed between the aperture 116 and the ribbed portion 114.

The ribbed portion 114 is sized and configured to pass through a gripping member 120. The gripping member 120 comprises a mounting member 122 and a clasp 124. The clasp 124 can be secured to the mounting member 122 in any suitable manner (e.g., mechanically interlocking constructions, threaded fasteners, etc.) and, in the illustrated arrangement, the clasp 124 is secured to the mounting member 122 with a rivet 126. In some embodiments, the clasp 124 can be formed integrally with the mounting member 122.

The clasp 124 has a construction that allows the ribbed portion 114 to be inserted into the clasp 124. The clasp 124 then can be manipulated to allow selective movement of the ribbed portion 114 within the clasp 124. The selective movement allows the length of the strap to be adjusted such that users having various feet sizes can be accommodated. In the illustrated arrangement, a physical stop is incorporated into the strap 112 to reduce the likelihood that the strap 112 will be completely removed from the clasp. In the illustrated arrangement, the stop comprises a rivet 128. Other suitable stop configurations can be used if desired; however, the rivet 128 provides a simple and effective manner of creating a physical stop.

The illustrated pedal 86 comprises a pair of ears 130. The ears 130 allow the strap 112 to be releasably connected to the pedal 86. One ear is sized and configured to extend through an aperture formed in the mounting member 122 and the other ear is sized and configured to extend through the aperture 116 in the strap 112. In other embodiments, either the mounting member 122 or the other end of the strap 112 can be permanently or semi-permanently attached to the pedal 86. The illustrated arrangement, however, advantageously allows for easy removal and replacement of the strap if needed or desired. In addition, the arrangement allows removal of the strap 112 for length adjustments if desired.

The feet 17 preferably support the illustrated frame assembly 12. The feet 17 allow the frame assembly 12 to be leveled and to sit slightly above the floor surface on which the frame assembly 12 is supported. In one arrangement, fixed wheels 132 can be provided at one end, preferably the front. Accordingly, the rear of the bicycle 10 can be raised upward which places the wheels 132 in engagement with the ground such that the bicycle 10 can be easily relocated.

Figures 14, 15:
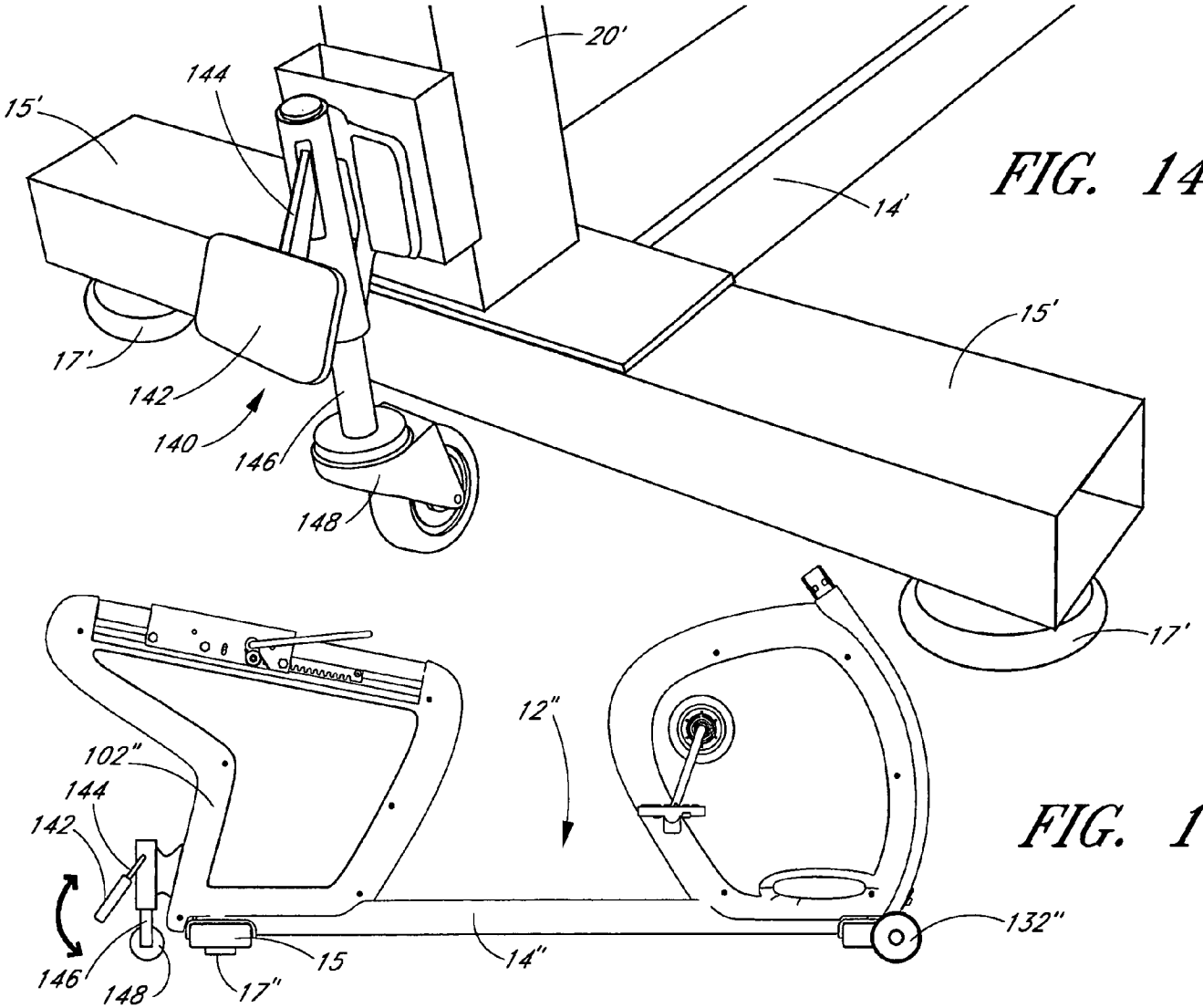
FIG. 14 is a simplified isometric view of a rear portion of a bicycle with a selectively deployable caster assembly.
FIG. 15 is a simplified side elevation view of a portion of another bicycle with a selectively deployable caster assembly.

With reference to FIGS. 14 and 15, a selectively deployable roller or retractable caster assembly 140 can be attached to the exercise device 10', 10" (like components between an earlier embodiment and the embodiments of FIGS. 14 and 15 have been given like reference numerals with the addition of a single prime ' in the embodiment of FIG. 14 and a double prime " in the embodiment of FIG. 15). The selectively deployable caster assembly 140 can be connected to a rear portion of the exercise device 10', 10" in any suitable manner. Advantageously, the assembly 140 comprises a member that can be lowered into a position that raises the rear of the exercise device 10', 10". With the member of the assembly 140 lowered, the wheels 132" at the other end of the bicycle preferably are brought into contact with the ground due to the angle of inclination and the location of the wheels 132" forward of the front end of the frame assembly 12". Thus, by lowering the member of the assembly 140, the bicycle can be supported on rollers to further ease movement of the bicycle, when desired.

In the illustrated arrangement, the retractable caster assembly 140 preferably comprises a step pad 142 that is mounted on a lever 144. The lever 144 can be connected to a post 146 that can be connected to the wheel 148. As the lever 144 is pivoted downward, the post 146 is moved downward within an outer sleeve 150 such that the wheel 148 is driven into the ground or other supporting surface. As the wheel 148 is driven downward, the rear portion of the exercise device is lifted upward. The exercise device then is able to be easily moved about the facility. Any other suitable selectively deployable caster assembly also can be used. See, for example, U.S. Pat. No. 4,249,282, which is incorporated herein in its entirety. In one arrangement, the retractable caster can be locked from movement such that a key or other access-limiting device is required for operation of the caster.

The retractable caster assembly 140 can be mounted either to a portion of the frame assembly 12 or to a portion of the housing such as the seat housing 102. In one preferred arrangement, the assembly 140 is substantially contained within enclosure such that the assembly 140 generally does not adversely affect the pleasing aesthetic appearance of the exercise equipment.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. An exercise machine comprising a frame, said frame comprising a base, a seat mounted to a rear portion of said frame and a display mounted to a forward portion of said frame, a resistance force generating assembly being disposed generally below a portion of said display, said resistance force generating assembly being disposed within a first housing, a second housing being formed separate of said first housing, said second housing being nonmoveably secured to said frame and being disposed generally rearward of said first housing, an opening being defined between said first and said second housings, said opening being wider at a location proximate said base than at an elevation higher than said location and at least a portion of said second housing being positioned forward of a generally vertical plane defined along a forwardmost portion of said seat, an adjustable reading support being supported by said frame, said reading support being adjustable from said forward portion of said frame toward and away from said seat of said machine, said reading support comprising a standard with at least two holes and a plunger rod that is connected to a locking finger, said locking finger being capable of selective registry with either of said at least two holes.

2. The machine of claim 1, wherein said seat is supported above at least a portion of said second housing and said seat is adjustable relative to said second housing through an adjustment mechanism, said adjustment mechanism comprising a handle that wraps around at least two contiguous sides of said seat.

3. The machine of claim 2, wherein said resistance force generating assembly comprises a pair of pedals.

4. The machine of claim 3, wherein each of said pedals comprise an adjustable strap assembly.

5. The machine of claim 4, wherein said adjustable strap assembly comprises a flexible strap with an aperture at a first end and a ribbed portion at a second end.

6. The machine of claim 5, wherein said aperture is adapted to fit over an ear of said pedal.

7. The machine of claim 5, wherein said ribbed portion is adapted to fit within a gripping member.

8. The machine of claim 7, wherein said gripping member comprises a clasp and a mounting member and said mounting member is adapted to fit over an ear of said pedal.

9. The machine of claim 1 further comprising a pair of fixed wheels extending forward of said frame assembly, said wheels not contacting a surface on which said machine is resting when a rear of said machine is not lifted.

10. The machine of claim 1, wherein said plunger rod is connected to said locking finger with a rocker arm.

11. The machine of claim 1, wherein said plunger rod is connected to a button such that movement of said button causes movement of said plunger rod.

12. The machine of claim 1, wherein said reading support comprises a front support member and a rear support member such that reading media can be supported between said front support member and said rear support member.

13. The machine of claim 12, wherein said reading support further comprises a biasing member that biases said front support member and said rear support member together.

14. The machine of claim 1, wherein said reading support comprises a gripping structure.

15. The machine of claim 1, wherein said seat comprises an arm rest and a seat cushion, said arm rest being pivotally mounted relative to said seat cushion.

16. An exercise machine comprising a frame, a seat supported by a rear portion of said frame, a hand grip being supported by a forward portion of said frame, a resistance force generating assembly being disposed on said forward portion of said frame, a reading support being movably supported by said forward portion of said frame, said reading support comprising a pair of members that enable telescoping movement of said reading support, said pair of members consisting of an outer tubular member and an inner tubular member, a locking assembly extending through said inner tubular member and said locking assembly comprising a finger that engages an opening in said outer tubular member, said locking assembly being connected to an actuator and movement of said actuator facilitating unlocking of said locking assembly, said actuator being a push button, said locking assembly comprising a plunger rod and said push button being secured to said plunger rod, said reading support being disposed forward of said seat and comprising a reading material holder that is extendable toward said seat relative to said forward portion of said frame that supports said reading support, a display being supported by said forward portion of said frame, said reading support being disposed between said display and said seat.

17. An exercise machine comprising a frame, a seat supported by a rear portion of said frame, a hand grip being supported by a forward portion of said frame, a resistance force generating assembly being disposed on said forward portion of said frame, a reading support being movably supported by said forward portion of said frame, said reading support comprising a pair of members that enable telescoping movement of said reading support, said pair of members consisting of an outer tubular member and an inner tubular member, a locking assembly extending through said inner tubular member and said locking assembly comprising a finger that engages an opening in said outer tubular member, said locking assembly being connected to an actuator and movement of said actuator facilitating unlocking of said locking assembly, said reading support being disposed forward of said seat and comprising a reading material holder that is extendable toward said seat relative to said forward portion of said frame that supports said reading support, said actuator being a plunger knob, said locking assembly comprising a plunger rod and said plunger knob being secured to said plunger rod such that movement of said plunger rod in either direction along a axis of said plunger rod results in unlocking of said locking assembly, and a display being supported by said forward portion of said frame, said reading support being disposed between said display and said seat.

18. An exercise machine comprising a frame, a seat supported by a rear portion of said frame, a hand grip and a display being supported by a forward portion of said frame, a resistance force generating assembly being disposed on said forward portion of said frame, a reading support being movably supported by said forward portion of said frame, said reading support being disposed between said display and said seat, said reading support comprising a pair of members that enable telescoping movement of said reading support such that said reading support is adjustable relative to said seat, said pair of members consisting of an outer tubular member and an inner tubular member, a locking assembly extending through said inner tubular member, said locking assembly comprising a finger that engages an opening in said outer tubular member, said locking assembly being connected to an actuator and movement of said actuator facilitating unlocking of said locking assembly, wherein said actuator is a push button, said locking assembly comprises a plunger rod and said push button is secured to said plunger rod.

19. An exercise machine comprising a frame, a seat supported by a rear portion of said frame, a hand grip and a display being supported by a forward portion of said frame, a resistance force generating assembly being disposed on said forward portion of said frame, a reading support being movably supported by said forward portion of said frame, said reading support being disposed between said display and said seat, said reading support comprising a pair of members that enable telescoping movement of said reading support such that said reading support is adjustable relative to said seat, said pair of members consisting of an outer tubular member and an inner tubular member, a locking assembly extending through said inner tubular member, said locking assembly comprising a finger that engages an opening in said outer tubular member, said locking assembly being connected to an actuator and movement of said actuator facilitating unlocking of said locking assembly, said actuator being a plunger knob, said locking assembly comprising a plunger rod and said plunger knob being secured to said plunger rod such that movement of said plunger rod in either direction along an axis of said plunger rod results in unlocking of said locking assembly.

20. An exercise machine comprising a frame, said frame comprising a base, a seat mounted to a rear portion of said frame and a display mounted to a forward portion of said frame, a resistance force generating assembly being disposed generally below a portion of said display, said resistance force generating assembly being disposed within a first housing, a second housing being formed separate of said first housing, said second housing being nonmoveably secured to said frame and being disposed generally rearward of said first housing, an opening being defined between said first and said second housings, said opening being wider at a location proximate said base than at an elevation higher than said location, an adjustable reading support that is supported by said frame, said reading support being adjustable from said forward portion of said frame toward and away from said seat of said machine, said reading support comprising a support member with at least two holes and a plunger rod that is connected to a locking finger, and said locking finger being capable of selective registry with either of said at least two holes.

21. The machine of claim 20, wherein said plunger rod is connected to said locking finger with a rocker arm.

22. The machine of claim 21, wherein said plunger rod is connected to a button such that movement of said button causes movement of said plunger rod.

23. The machine of claim 20, wherein said reading support comprises a channel.

24. The machine of claim 20, wherein said reading support comprises a front support member and a rear support member such that reading media can be supported between said front support member and said rear support member.

25. The machine of claim 24, wherein said reading support further comprises a biasing member that biases said front support member and said rear support member together.

26. The machine of claim 20, wherein said reading support comprises a gripping structure.

27. The machine of claim 20, wherein said seat comprises an arm rest and a seat cushion, said arm rest being pivotally mounted relative to said seat cushion.

28. The machine of claim 20, wherein said seat is supported above at least a portion of said second housing and said seat is adjustable relative to said second housing through an adjustment mechanism, said adjustment mechanism comprising a handle that wraps around at least two contiguous sides of said seat.

29. The machine of claim 28, wherein said resistance force generating assembly comprises a pair of pedals.

30. The machine of claim 29, wherein each of said pedals comprise an adjustable strap assembly.

31. The machine of claim 30, wherein said adjustable strap assembly comprises a flexible strap with an aperture at a first end and a ribbed portion at a second end.

32. The machine of claim 31, wherein said aperture is adapted to fit over an ear of said pedal.

33. The machine of claim 31, wherein said ribbed portion is adapted to fit within a gripping member.

34. The machine of claim 33, wherein said gripping member comprises a clasp and a mounting member and said mounting member is adapted to fit over an ear of said pedal.

35. The machine of claim 20 further comprising a pair of fixed wheels extending forward of said frame assembly, said wheels not contacting a surface on which said machine is resting when a rear of said machine is not lifted.

* * * * *